US010431923B2

(12) United States Patent
Tovar Murcia

(10) Patent No.: US 10,431,923 B2
(45) Date of Patent: Oct. 1, 2019

(54) PROGRESSIVE-ACTION SEALING SYSTEM FOR ELECTRICAL CONDUCTORS

(71) Applicant: Nelson Enrique Tovar Murcia, Cundinamarca (CO)

(72) Inventor: Nelson Enrique Tovar Murcia, Cundinamarca (CO)

( * ) Notice: Subject to any disclaimer, the term of this patent is extended or adjusted under 35 U.S.C. 154(b) by 497 days.

(21) Appl. No.: 15/034,103

(22) PCT Filed: Nov. 22, 2013

(86) PCT No.: PCT/CO2013/000010

§ 371 (c)(1),
(2) Date: May 3, 2016

(87) PCT Pub. No.: WO2015/067222

PCT Pub. Date: May 14, 2015

(65) Prior Publication Data

US 2016/0265697 A1 Sep. 15, 2016

(30) Foreign Application Priority Data

Nov. 5, 2013 (CO) ..... CO13261118

(51) Int. Cl.

| | |
|---|---|
| ***H01R 13/523*** | (2006.01) |
| ***H01R 13/52*** | (2006.01) |
| ***E21B 1/00*** | (2006.01) |
| ***E21B 33/038*** | (2006.01) |

(52) U.S. Cl.

CPC ..... *H01R 13/5205* (2013.01); *E21B 1/00* (2013.01); *E21B 33/0385* (2013.01); *H01R 13/523* (2013.01)

(58) Field of Classification Search

CPC ..... H01R 13/5205; H01R 13/523; E21B 33/0385; F16L 33/0385; F16L 17/00

USPC ..... 285/101, 102, 103

See application file for complete search history.

(56) References Cited

U.S. PATENT DOCUMENTS

| | | | | |
|---|---|---|---|---|
| 2,670,973 A * | 3/1954 | Ginther | F04D 29/128 | 285/101 |
| 3,097,866 A * | 7/1963 | Iversen | F16L 33/16 | 285/101 |
| 4,154,302 A * | 5/1979 | Cugini | E21B 33/0407 | 166/378 |
| 4,906,030 A * | 3/1990 | Yokomatsu | F16L 33/16 | 285/101 |

(Continued)

*Primary Examiner* — David Bochna

(74) *Attorney, Agent, or Firm* — Hoglund & Pamias, PSC; Roberto J. Rios

(57) ABSTRACT

Progressive Sealing System (SSAP) is a mechanism that allows communicating and sealing conductive elements (electrical or else) from a pressurized area to one that is not, or areas that have different pressure rates, through the use of piston-type movable components (3) that assemble mechanically by joining the upper connector (1) with the pressure chamber (8); the conductive elements are sealed by elastomers (5) to form a bidirectional pressure seal that acts progressively to the existing pressure force and in the direction which to higher pressure is flowing to. It can be used in oil and gas Wells to isolate areas with different pressure or with the exterior of the well. It can also be used by any industry sector that may require to communicate conductors through areas with different pressure.

8 Claims, 6 Drawing Sheets

(56) References Cited

U.S. PATENT DOCUMENTS

| | | | | | |
|---|---|---|---|---|---|
| 4,927,386 | A * | 5/1990 | Neuroth | E21B 17/028 | 439/201 |
| 5,051,103 | A * | 9/1991 | Neuroth | E21B 33/0385 | 439/192 |
| 5,149,145 | A * | 9/1992 | Yokomatsu | F16L 33/227 | 285/101 |
| 6,319,073 | B1 * | 11/2001 | Menolotto | G02B 6/3816 | 439/744 |
| 9,388,654 | B2 † | 7/2016 | Urrego Lopera | | |
| 2012/0100737 | A1 * | 4/2012 | Frey | H01R 13/523 | 439/271 |

* cited by examiner
† cited by third party

PROGRESSIVE-ACTION SEALING SYSTEM FOR ELECTRICAL CONDUCTORS

FIELD OF THE INVENTION

The present invention refers to a Progressive Sealing System to communicate electrical or other type of conductors through sealed areas with different pressures and isolated to each other, in order to ensure a hermetic seal between areas that will be used mainly in the energy sector, oil subsector and, particularly in the production of oil and gas wells that use electrical devices inside.

BACKGROUND OF THE INVENTION

We find that the fluid produced by the well (oil or water) do not flow to the surface alone; therefore, there are several types of extraction or artificial lift including Electric Submersible Pumps (ESP), Progressive Cavity Pumps (PCP), which requires electrical heaters in the bottom of the well—in case of heavy oil (API low viscosity)—to lighten oil and pump it easily. As these systems are electrical, they need to be plugged to sources of electricity in the surface of the well using electric cables; this makes it necessary to design power connectors to communicate and seal pressure between isolated production areas and the exterior through the wellhead.

Nowadays, there are power connectors in the market, called penetrators, manufactured by American and European corporations which models are known as close socket penetrator, uncut epoxy-sealed penetrators, uncut mechanically-sealed penetrators. The first uses a closed capsule called penetrator that is placed through the wellhead with an external mechanical seal and allow electrical connections (cut in the cable) to the inner part of the head (pressurized) and to the outer part; this generates hot spots that decrease the electrical rating of the cable and creates a risk of power failure that must be minimized using delayed connection procedures (up to 5 hours) and that require controlled environmental conditions (relative temperature and humidity) that in most of the operations are variables that cannot be controlled easily; moreover, if a power failure occurred in these connections under the head, they would require the intervention of a special oil well repair and service crew called Work Over, which calling is expensive and undesirable. The uncut epoxy-sealed penetrators allow the users to avoid cutting the conductors because they use the principle of not making electrical connections to the pressurized area; they use a sealing system under the wellhead that comprises a capsule with a seal or gasket and epoxy fillers (that need controlled environmental conditions under the risks above mentioned) and that passes the cable through the head without cuts; however, the assembly procedure is problematic because it requires controlled environmental conditions and an epoxy mixture that can produce flaws in the sealing if it is not done properly. Also, this epoxy resin can lose sealing properties through time and expose the well to eventual leaks.

The uncut mechanically-sealed penetrator does not use epoxy resins; thus, it produces a mechanical sealing based on conical gaskets placed upon conical bores that once they are compressed through the use of a thread, they strangle or press the three conductors (the only sealing alternative) and create a one-way seal; however, it does not consider the measurements of the various types of cable in the market and this condition creates a risk of leaks because the cables cannot be sufficiently tightened; or, otherwise, it can damage the conductor if it is tightened more than necessary; likewise, the different sizes of conductors require different gaskets; therefore, there is a risk of installing a gasket of the wrong size; also, this system is based on the retention of pressure only in the gasket; through time, this continued condition can make the gasket fail and lead to an inevitable pressure leak that can cause incidents, such as those well known cases in productive wells in Colombia. Finally, all these systems were designed only to create a one-way seal under the head and in groups of three conductors, which limits the number of applications that the users can give in accordance with the well completion and reaction in case of a failure without having to use Work Over crews.

SUMMARY OF THE INVENTION

The Progressive Sealing System of the patent application presents the following advantages in view of the state of the art:

- Progressive piston tightening system. It gives constant sealing pressure according to the pressure received. The higher the pressure the better sealing is produced and vice versa; this minimizes the risk of damages to the conductor.
- Two-way sealing system that will act progressively to the existing pressure force and in the direction where the higher pressure moves.
- It uses a single-size unique geometry elastomer that adapts to several types of conductors due to the action of the progressive piston.
- The moving piston receives the pressures and avoids the risk of deformation or damage of the elastomer seal.
- This system can be used in the outer part of the wellhead without having to make connections; this gives the possibility to perform inspections or repairs in the outer part, as well as replace the systems that fell into disuse without having to use well service crews (Work Over).
- This system configures to seal 1-9 conductors depending on users' needs; this gives the possibility to seal all the conductors with a single system and not in groups of three.
- All the components in touch with the conductors are manufactured with dielectric and isolating materials that reduce the risk of physical electrical damage of the conductor.
- The elastomer of the seal contains compounds specially designed to resist corrosive gases (such as H2S), solvents, and hydrocarbons, and for works under high temperature or pressure. The system was designed and proved to resist work pressures of as much as 34,500 Kilopascals (kPa).
- This system can replace any type of sealing system installed before without having to change the existing equipment.

DETAILED DESCRIPTION OF THE INVENTION

Figure 1:
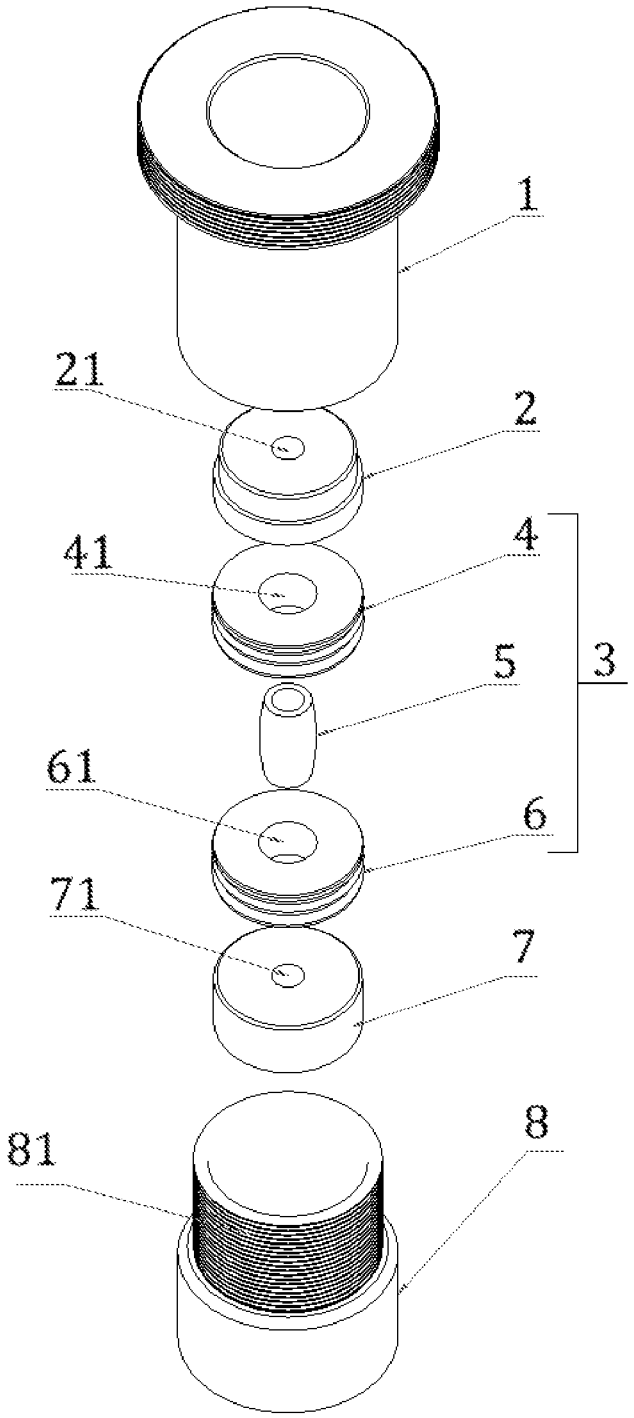
FIG. 1 Perspective and detailed view of the mono conductor progressive piston Sealing System (3) of the invention patent.

The Progressive Sealing System [hereinafter referred to as "SSAP" for its abbreviation in Spanish] of the present invention patent application, as per FIG. 1, consists of: a) an upper connector (1); b) an upper "pre-seal" (2); c) a mono conductor progressive piston (3) comprising: i) an upper piston (4); ii) one or several elastomeric seals (5); iii) a lower piston (6); d) a lower "pre-seal" (7); and e) a pressure chamber (8).

In view of the problems described in the state of the art, the Progressive Sealing System (SSAP) was designed to seal conductive elements that pass between two areas with different pressure rates without cutting them and without having to make connections under the wellhead.

SSAP uses piston-type movable components (3) inside a pressure chamber (8), as well as an upper (2) and a lower "pre-seal" (7) to seal the conductive elements through the use of one or several elastomers (5) depending on the number of conductors—either simple or multiple—that are to be sealed; they are assembled mechanically by connecting the upper connector (1) with the pressure chamber (8), thus forming a bidirectional pressure barrier seal that acts progressively against the existing pressure force and in the direction to which the pressure is flowing.

If the pressure flows from the lower to the upper part, the lower piston (6) will move progressively and proportionally to the pressure force toward the upper piston (4); and it is the piston which receives the pressure force directly and not the elastomer making the latter (5) compress evenly and press the seal against the conductor more strongly; this ensures the lowest possible level of risk of failure of the conductor as a result of the seal's applying an exaggerated force.

If the pressure flows from the upper to the lower part the opposite effect will take place: the upper piston (4) will move progressively and proportionally to the pressure force toward the lower piston (6) which produces a sealing force that is proportional to the pressure force and is bidirectional. This makes the system unique and gives the user the possibility to use it not only in the lower part of the head but in the upper part, too, as well as in the zone isolation gaskets and even outside the head, on the surface of the well.

With this system, users do not have the only option to seal three conductors; they can configure the system to seal 1-9 conductors.

The non-progressive sealing systems receive the pressure in the seal, and it tends to deform the seal until it finally fails; also, the seal is in a fixed place (it does not move) so it makes the pressure concentrate on the seal; conversely, the progressive system of the present invention makes the pressure to be received by the piston and not the seal, which causes the piston to move and seal the system progressively to the pressure force; the seal does not receive directly the pressure; therefore, the risk to damage the elastomer due to the pressure is minimum.

The components of SSAP that contact the conductors are manufactured in dielectric and isolating materials. Also, the elastomeric seal contains compounds especially designed for the application. They make it resistant to any type of corrosive gas such us HQS, as well as to the attack of solvents, high temperatures and pressure.

FIG. 1 is a perspective and detailed view of the mono conductor progressive piston Sealing System (3) of the invention patent which shows: the upper connector (1), the upper "pre-seal" (2) having a pass-through opening (21), the mono conductor progressive piston (3) with the upper piston (4) having a pass-through opening (41), the elastomeric seal (5), the lower piston (6) having a pass-through opening (61), the lower "pre-seal" (7) having a pass-through opening (71) and the pressure chamber (8) having threads (81). As can be appreciated from the figure, pass-through openings (21) and (71) have a diameter smaller than the diameters of pass-through opening (41), pass-through opening (61) and elastomeric seal (5).

Figure 2:
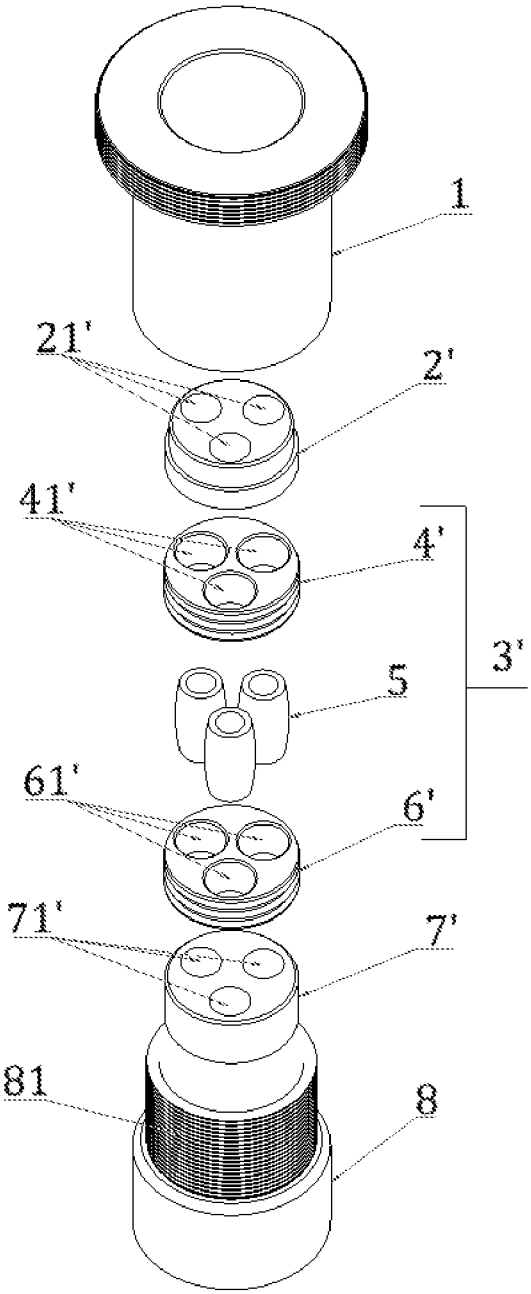
FIG. 2 Perspective and detailed view of the multi conductor progressive piston Sealing System (3') of the invention patent.

FIG. 2 is a perspective and detailed view of the multi conductor progressive piston Sealing System (3') of the invention patent which shows: the upper connector (1), the upper "pre-seal" (2) having a plurality pass-through openings (21'), the multi conductor progressive piston (3') with the upper piston (4') having a plurality pass-through openings (41'), the a plurality of elastomeric seals (5), the lower piston (6') having a plurality pass-through openings (61'), the lower "pre-seal" (7') having a plurality pass-through openings (71') and the pressure chamber (8) having threads (81). As can also be appreciated from the figure, pass-through openings (21') and (71') have a diameter smaller than the diameters of pass-through openings (41'), pass-through openings (61') and elastomeric seals (5).

Figure 3:
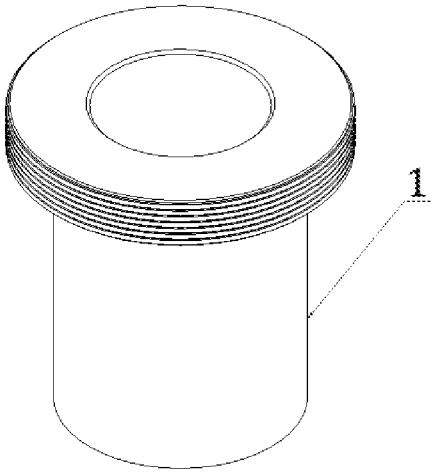
FIG. 3 Perspective view of the upper connector (1) of the Sealing System.
Figure 4:
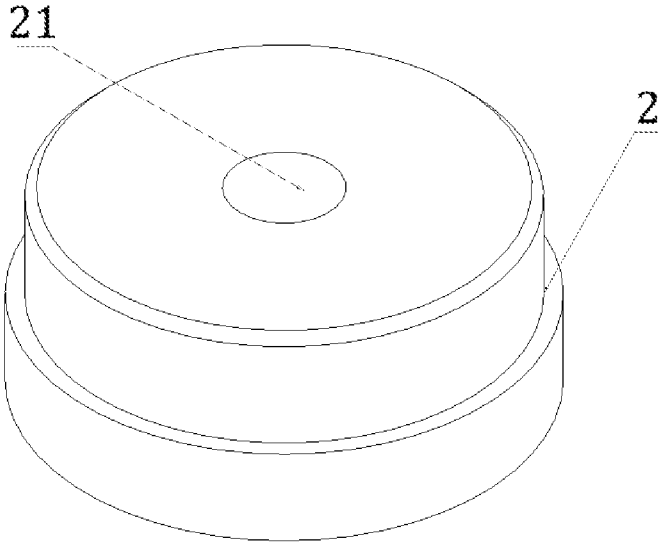
FIG. 4 Perspective view of the upper "pre-seal" (2) of the Sealing System.
Figure 5:
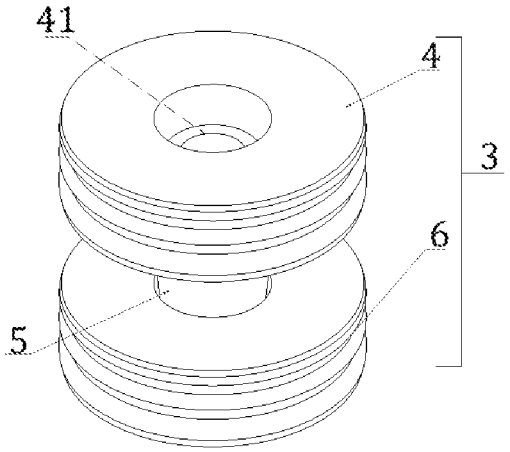
FIG. 5 Perspective view of the mono conductor progressive piston (3) of the Sealing System.
Figure 6:
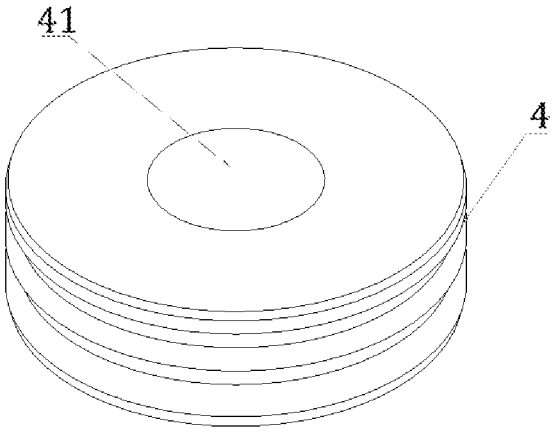
FIG. 6 Perspective view of the upper piston (4) of the Sealing System.
Figure 7:
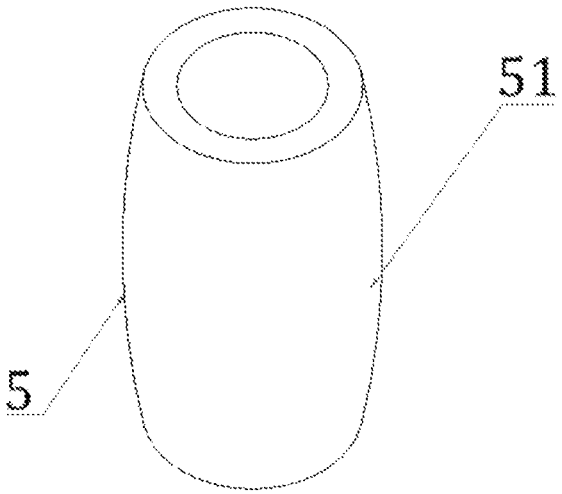
FIG. 7 Perspective view of the elastomeric seal (5) of the Sealing System.
Figure 8:
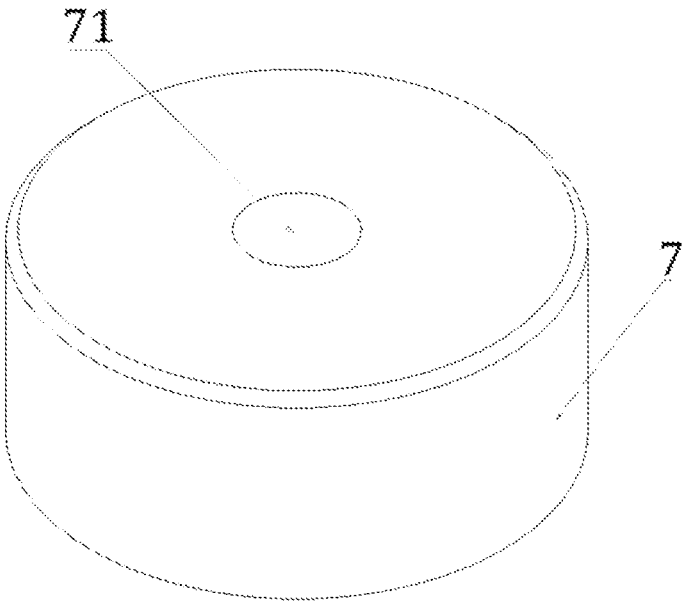
FIG. 8 Perspective view of the lower "pre-seal (7) of the Sealing System.
Figure 9:
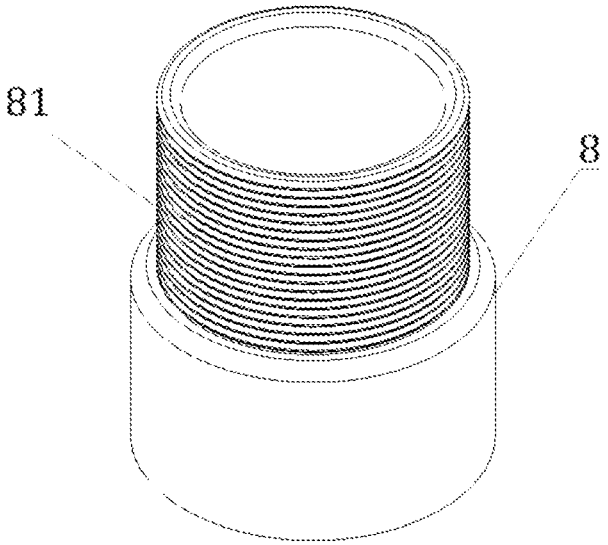
FIG. 9 Perspective view of the pressure chamber (8) of the Sealing System.
Figure 10:
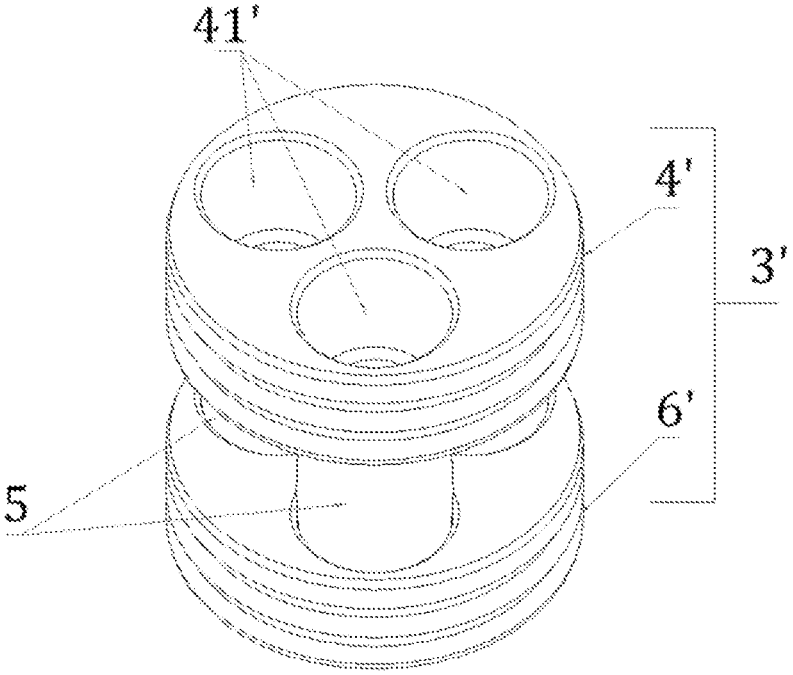
FIG. 10 Perspective view of the multi conductor progressive piston (3') of the Sealing System.

FIG. 3 shows the perspective view of the upper connector (1) of the Progressive Sealing System.

The invention claimed is:

1. A progressive action sealing system for electric conductors comprising:

a progressive piston assembly (3) having a plurality of elastomers (5) that is assembled between an upper piston (4) and a lower piston (6), wherein each elastomer of said plurality of elastomers (5) is configured to separately receive one electrical conductor within for sealing and isolating said electrical conductor;

a pressure chamber (8) having an upper pre-seal (2) and a lower pre-seal (7), wherein said progressive piston assembly (3) is located inside said pressure chamber (8) between said upper pre-seal (2) and said lower pre-seal (7); and an upper adapter (1) removably attached to said pressure chamber (8) to enclose said progressive piston assembly (3) so that said progressive piston assembly (3) works bi-directionally, receiving pressure at either end while compressing uniformly the at least one elastomer (5), wherein said progressive piston assembly (3) serves as a bidirectional and progressive pressure seal barrier depending on the pressure and the applied direction of the force received on each side of the seal.

2. The progressive action sealing system of claim 1, wherein said lower piston (6) moves upward when receives an upward pressure causing the at least one elastomer (5) to be compressed against the upper piston (4) or said upper piston (4) moves downwards when receives an upward pressure causing the at least one elastomer (5) to be compressed against the lower piston (6) so that the force vector changes direction towards the center of the at least one electric conductor forming a hermetic seal with progressive seal force directly proportional to the pressure received by the piston.

3. The progressive action sealing system of claim 1, wherein said at least one elastomer (5) has an elliptical external surface.

4. The progressive action sealing system of claim 1, wherein each of said plurality elastomers (5) has an elliptical external surface.

5. The progressive action sealing system of claim 1, wherein a diameter of at least one upper pre-seal passthrough opening (21) provided on said upper pre-seal (2) and a diameter of at least one lower pre-seal passthrough opening (71) provided on said lower pre-seal (7) is smaller than a diameter of a lower piston passthrough opening (61) provided on said lower piston (6) and a diameter of an upper piston passthrough opening (41) provided on said upper piston (4) effectively limiting the longitudinal deformation of said at least one elastomer (5) when pressure is received.

6. The progressive action sealing system of claim 1, wherein the sealing system is provided below, above or within a wellhead.

7. The progressive action sealing system of claim 1, wherein all the components of the sealing system that contact the at least one electrical conductor are made from dielectric materials resistant to corrosive gases, solvents, high temperatures and pressure.

8. The progressive action sealing system of claim 1, wherein the sealing system supports pressures up to 34,500 kPa and temperatures, under working conditions, of up to 220° C.

* * * * *